US005586140A

United States Patent [19]

Ishida et al.

[11] Patent Number: 5,586,140

[45] Date of Patent: Dec. 17, 1996

[54] PLASMA MELTING METHOD AND PLASMA MELTING FURNACE

[75] Inventors: Michio Ishida, Nara; Tsutomu Kuwahara, Nara-ken; Hideo Sato, Toyonaka; Yoshitoshi Sekiguchi, Maizuru; Kunio Sasaki, Maizuru; Shiro Sakata, Maizuru; Hiroshi Kosaka, Yao; Toshio Hirai, Yamatokouriyama, all of Japan

[73] Assignee: Hitachi Zosen Corporation, Japan

[21] Appl. No.: 511,092

[22] Filed: Aug. 3, 1995

[30] Foreign Application Priority Data

Aug. 10, 1994 [JP] Japan ..... 6-187632
Jun. 19, 1995 [JP] Japan ..... 7-150783

[51] Int. Cl.[6] ..... H05B 7/00

[52] U.S. Cl. ..... 373/18; 373/25; 373/66

[58] Field of Search ..... 373/18, 19, 22, 373/24, 25, 66; 219/121.36

[56] References Cited

U.S. PATENT DOCUMENTS 4,521,890 6/1985 Burnham et al. ..... 373/22
4,694,464 9/1987 Salvador ..... 373/22
5,046,145 9/1991 Drouet ..... 219/121.36
5,132,984 7/1992 Simpson ..... 373/18
5,278,861 1/1994 Damond et al. ..... 373/10
5,376,767 12/1994 Heanley et al. ..... 219/121.36
5,403,991 4/1995 Tylko ..... 219/121.36

FOREIGN PATENT DOCUMENTS

0157104A1 10/1984 European Pat. Off. .
0122910A1 10/1989 European Pat. Off. .
3-55792 3/1991 Japan .

*Primary Examiner*—Tu Hoang
*Attorney, Agent, or Firm*—D. Peter Hochberg; Mark Kusner; Michael Jaffe

[57] ABSTRACT

A plasma melting furnace has a melting chamber having an anode torch and a cathode torch made of graphite and having a electric conductor disposed on the bottom thereof. When the furnace is operated, the anode torch, having an inflow of electrons, which forms an unstable plasma arc is contacted with the electric conductor and is not used, while the cathode torch, having an outflow of electrons, which forms a stable plasma arc, is utilized for heating, whereby the furnace can be stably and continuously operated. Thus, since the cathode torch which is used is not heated so much and the anode torch, which is liable to be heated to a great degree, is not used, the electrode consumption rate can be greatly reduced.

39 Claims, 7 Drawing Sheets

PLASMA MELTING METHOD AND PLASMA MELTING FURNACE

FIELD OF THE INVENTION

The present invention relates to a plasma melting method and a plasma melting furnace for treating by melting of materials to be melted, such as incineration residues and fly ash left in an incinerator, by using plasma arcs.

BACKGROUND OF THE INVENTION

An incineration residue, for example, incineration ash, discharged from an incinerator for municipal refuse is treated for reduction in volume by melting in a melting furnace.

Conventionally, as one of such melting furnaces, a plasma melting furnace has been used. There are two types of plasma melting furnaces according to the disposition or the electrodes; a transfer type and a non-transfer type. A twin torch type out of the transfer type has an anode or a cathode installed in a torch and the other electrode installed outside the torch, e.g., on the bottom of a melting chamber. The non-transfer type has an anode and a cathode which are installed in one torch. The twin torch type has an anode and a cathode which are installed in each of a plurality of torches. Of these types, the twin torch type is the most superior in the maintenance and control of the electrodes.

And this twin torch type plasma melting furnace has anode and cathode torches of graphite disposed in the upper region of the melting chamber in the furnace body, and a molten base metal, which is an electric conductor, disposed in the bottom of the melting chamber. And plasma arcs are generated between the two electrode torches and the base metal to heat and melt incineration ash charged onto the base metal, the plasma arcs generated by these anodes and cathodes being substantially equally utilized.

In this connection, the plasma generating phenomenon at the cathode and anode torches is characterized in that the plasma at the anode having an inflow of electrons is less stable than the plasma at the cathode having an outflow of electrons. Therefore, when there is a large variation in the conditions for the furnace, e.g., when the furnace is started and hence plasma is started, during temperature rise or in the initial periods of the charging of a material to be melted (incineration ash) into the furnace, it is difficult to maintain the generation of plasma arcs; therefore, there has been a problem that the operation is intermittent.

Further, it is at the anode torch having an inflow of electrons rather than at the cathode torch having an outflow of electrons that the electrode tip is more heated. Therefore, in the case of an electrode of graphite, the anode torch tip is heated to a higher temperature, presenting a problem of severe electrode consumption.

DISCLOSURE OF THE INVENTION

Accordingly, an object of the present invention is to provide a plasma melting method and a plasma melting furnace capable of solving the above problems.

To achieve this object, a melting method for a plasma melting furnace, according to the present invention, having anode and cathode torches of graphite and an electric conductor which is disposed on the bottom of a melting chamber, is characterized in that the cathode torch is disposed in the upper region of a melting chamber, while the lower end of the anode torch is contacted with the electric conductor.

Further, said plasma melting method is also characterized in that it is used when there is a large variation in the conditions for the furnace, e.g., when the furnace is started, during temperature rise or during the charging of a material to be melted into the furnace. Further, a plasma melting furnace according to the invention to achieve this object, having anode and cathode torches of graphite and an electric conductor which is disposed on the bottom of a melting chamber is characterized in that the cathode torch is disposed in the upper region of a melting chamber, while the lower end of the anode torch is contacted with the electric conductor.

Further, a plasma melting furnace having anode and cathode torches of graphite and an electric conductor which is disposed on the bottom of a melting chamber is characterized in that when there is a large variation in the conditions for the furnace, e.g., when the furnace is started, during temperature rise or during the charging of a material to be melted into the furnace, the cathode torch is disposed in the upper region of a melting chamber, while the lower end of the anode torch is contacted with the electric conductor.

According to the plasma melting method and plasma melting furnace, the continuous operation of the furnace becomes possible by utilizing the stable plasma arc from the cathode torch having an outflow of electrons rather than utilizing the unstable plasma arc from the anode torch having an inflow of electrons. Further, the electrode consumption rate can be greatly reduced by utilizing the plasma arc from the cathode torch which does not heat the electrode so much rather than utilizing the plasma arc from the anode torch which heats the electrode to a great degree.

DESCRIPTION OF THE EMBODIMENTS

Figure 1:
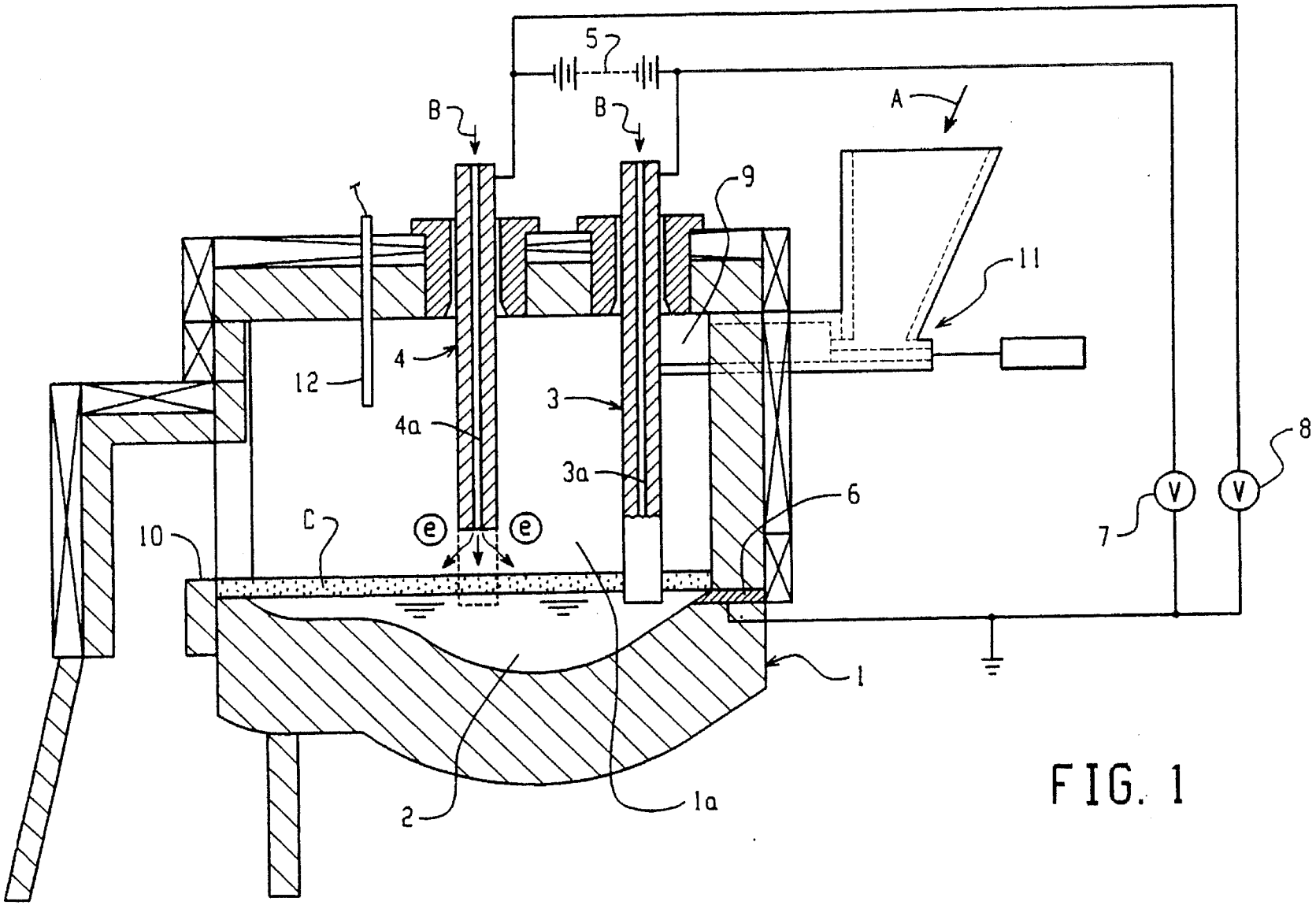
FIG. 1 is a sectional view of a plasma melting furnace in a first embodiment of the invention.

A first embodiment of the present invention will now be described with reference to FIG. 1.

In the first embodiment, reference will be made to a plasma type incinerator for melting an incineration residue, which is a material to be melted, e.g., incineration ash, from municipal refuse.

This plasma melting furnace comprises a furnace body 1 in which a base metal 2 which is an example of an electric conductor is disposed on the bottom of a melting chamber defined therein, an anode torch of graphite 3 and a cathode torch 4 of graphite disposed in the upper region of said melting chamber 1*a* of said furnace body 1, a power source 5 for feeding a predetermined current between these two torches 3 and 4, gas feeding means (not shown) for feeding gas when necessary to holes 3*a* and 4*a* formed in said electrode torches 3 and 4, manipulator arms (not shown) for individually raising and lowering the torches 3 and 4, a potential detector 6 made of electric conductor such as carbon brick for detecting the potential of the base metal 2, and potentiometers 7 and 8 disposed between the anode torch 3, cathode torch 4 and the potential detector 6 for detecting the respective potentials between the torches 3, 4 and melt pool (molten base metal 2 or molten slag C) or the solid base metal 2.

One side wall of the furnace body 1 is formed with a charging port 9 for incineration ash A which is a material to be melted. The other side wall is formed with a discharging port 10 for molten ash, which is a melt, i.e., a molten slag C. Further, in FIG. 1, the numeral 11 denotes an incineration ash feeding device for feeding incineration ash A into the charging port 9, and 12 denotes a thermometer, e.g., a thermocouple type thermometer for measuring the atmosphere temperature in the upper region of the melting chamber 1*a* which region is less influenced by a variation in the amount of ash A charged and in the amount of slag C produced.

The cathode torch 4 is disposed substantially in the middle of the melting chamber 1*a*, while the anode torch 3 is disposed near to the charging port 10.

How to operate said plasma melting furnace will now be described.

1. Starting the plasma melting furnace:

(A) A plasma activating gas B, e.g., nitrogen gas, is fed into the melting chamber la to provide an oxygen concentration of not more than 2%, and the lowered electrode torches 3 and 4 (shown in dashed lines in FIG. 1) are in contact with the base metal 2. And electric power for melting is supplied from the power source 5 to the electrode torches 3 and 4.

(B) A plasma arc is generated between the base metal 2 and the cathode torch 4.

In this furnace starting period, since the base metal 2 is solid at ordinary temperature and has rust or other adhering substance present on its surface, it is difficult to generate plasma arcs, and particularly it is very difficult to cause the anode and cathode torches 3 and 4 to generate plasma arcs at the same time. Therefore, with the anode torch 3 contacted with the base metal 2, a stable plasma arc is generated at the cathode torch 4 where electrons are discharged from the electrode.

In addition, when the plasma arc breaks, the cathode torch 4 is lowered to contact the base metal 2, whereupon the cathode torch 4 is raised again, so that a plasma arc is generated.

(C) After it has been confirmed that the base metal portion below the cathode torch starts to be melted by this plasma arc, the cathode torch 4 is raised to a heated arc position which is about 50 mm above the base metal 2, so as to continue the plasma arc, and the base metal 2 and the gas atmosphere in the melting chamber 1*a* are heated to higher temperatures. For example, at this time, the voltage on the anode torch 3 is 0–5 V, the voltage on the cathode torch 4 is 80 V, and the current is 300 A.

2. Heating up the plasma melting furnace:

(D) With the anode torch 3 brought into contact with the base metal 2, and with a plasma arc generated between the cathode torch 4 in the heated arc position and the base metal 2, the melt (melt pool) of the base metal 2 is enlarged. For example, at this time, the voltage on the anode torch 3 is 0–5 V, the voltage on the cathode torch 4 is 100–150 V, and the current is 1,000 A.

(E) When the furnace atmosphere temperature measured by the thermometer 12 reaches 900° C.–1000° C., the base metal 2 immediately below the anode torch 3 starts to melt. Thus, a clearance starts to form between the anode torch 3 and the base metal 2, which is an unstable state in which it is uncertain whether a plasma arc will be generated or not. Then, the anode torch 3 is raised a few millimeters to generate a plasma arc between the base metal 2 and the anode torch 3. In addition, 900° C. is a temperature at which incineration ash melts, and 1,000° C. and higher are temperatures at which the furnace wall fire-resistant material is liable to be burnt.

At this time if the plasma arc continues, the anode torch 3 is raised a preparatory arc position about 5–10 mm above the base metal 2. In addition, if the plasma arc breaks, the anode torch 3 is lowered into contact with the base metal 2, whereupon it raised again to generate a plasma arc. For example, the voltage on the anode torch 3 during continued plasma arcing is 50–100 V, the voltage on the cathode torch 4 is 100–150 V, and the current is 1,000 A.

(F) After the spreading of melting of the base metal 2 blow the anode torch 3 by this plasma arc has been confirmed, the anode torch 3 is raised to a heating arc position about 50 mm above the base metal 2 so as to continue the plasma arc, whereby the base metal 2 and the gas atmosphere in the furnace are heated for temperature rise. For example, the voltage on the cathode torch 4 is 100–150 V, the current is 1,000–1,300 A. and the atmosphere temperature in the furnace is held at about 1,000° C.

3. Charging incineration ash A into the plasma melting furnace:

(G) The voltage on the anode torch 3 is 100–150 V, the voltage on the cathode torch 4 is 100–150 V, the current is 1,000–1,300 A, and the atmosphere temperature in the furnace is held at about 1,000° C.. Under these conditions, when the base metal 2 is melted over the entire region, whereupon incineration ash A at low temperature is fed onto the molten base metal 2 through the charging port 9. When incineration ash A at low temperature is fed onto the base metal 2, the temperature of the latter is temporally decreased and molten slag is formed only locally, so that the plasma are voltage goes up, causing the plasma arc to be unstable.

(H) With the atmosphere temperature in the furnace held at about 1,000° C., the anode torch 3 in the heating arc position and the cathode torch 4 are raised to the melting arc position about 100 mm above the base metal 2.

(I) If the plasma arc is continued, the atmosphere temperature in the furnace is held at about 1,000° C. and the charging of incineration ash is continued.

(J) If the plasma arc breaks, the charging of incineration ash is interrupted. And after the anode and cathode torches 3 and 4 have been lowered into contact with the base metal 2 or molten slag C, the cathode torch 4 alone is raised from the preparatory arc position to the heating arc position to generate a plasma arc, the atmosphere temperature in the furnace being held at about 1,000° C. For example, the voltage on the anode torch 3 is 0–10 V, the voltage on the cathode torch 4 is 100 V, and the current is 300–1,000 A. Then, as in (E) and (F), the anode torch 3 is raised from the preparatory arc position to the heating arc position to generate a plasma arc. And the step moves to (G).

In addition, the length of the plasma arc from the cathode torch 4 during this operation is controlled on the basis of the potential difference detected between it and the melt pool (base metal 2 or molten slag C) by the potentiometer 8.

Further, when it is desired to finally stop the operation, the molten slag (molten ash) C and part or the base metal 2 are discharged as by tilting the furnace, and then the power source 5 is turned off. As for the electrode torches 3 and 4, they may be raised about 100 mm or more above the liquid surface of the base metal 2 in order to prevent them from sticking to the base metal 2.

According to the above embodiment, the unstable plasma arc from the anode torch 3 having an inflow of electrons is not utilized and instead the stable plasma arc from the cathode arc where electrons are discharged from the electrode is utilized, whereby continued operation of the furnace becomes possible. Further, since the plasma arc from the anode torch 3 which intensely heats the electrode tip is not utilized and instead the plasma arc from the cathode torch 4 which does not heat the electrode tip so much is utilized, the electrode consumption rate can be decreased.

Further, since the cathode torch 4 which generates a stable plasma arc is disposed substantially at the center of the melting chamber la, i.e., the melt pool, it is possible to make effective use of the plasma arc. Further, since the anode torch 3 is disposed close to the ash charging port which is on the lower temperature side, the electrode consumption rate can further be decreased.

Further, even if the anode torch 3 has its tip (lower end) consumed until its tip is positioned in the molten slag C, there is no possibility of the passage of electricity becoming unstable, since it is in contact with the molten slag layer.

Further, since the potentiometers 7 and 8 are installed between the base metal 2 and the anode torch 3 and between the base metal 2 and the cathode torch 4, the potentials between the torches 3, 4 and the solid base metal 2 or melt pool (molten base metal 2 or molten slag C) can be accurately measured. This makes it possible to effect accurate control of plasma arc generated at the cathode torch 4 and suppression of plasma arc generation at the anode torch 3.

Further, when there is a large variation in the operating conditions for the furnace as during starting of the furnace or in a temperature increasing period, the anode torch 3 is in contact with the base metal 2 and heated to 900° C.–1,000° C. by the plasma arc from the cathode torch 4; therefore, the problem of discontinuity of plasma arc can be eliminated and damage to the anode torch can be prevented. Further, on starting the charging of incineration ash A into the melt pool, only when the plasma arc is interrupted, the electrode torches 3 and 4 are brought into contact with the base metal. 2 or molten slag C, and then only the cathode torch 4 is raised while the temperature in the furnace is maintained by the plasma arc from the cathode torch 4; thus, the problem of discontinuity of the plasma arc is solved and the temperature in the furnace can be stably maintained.

Figure 2:
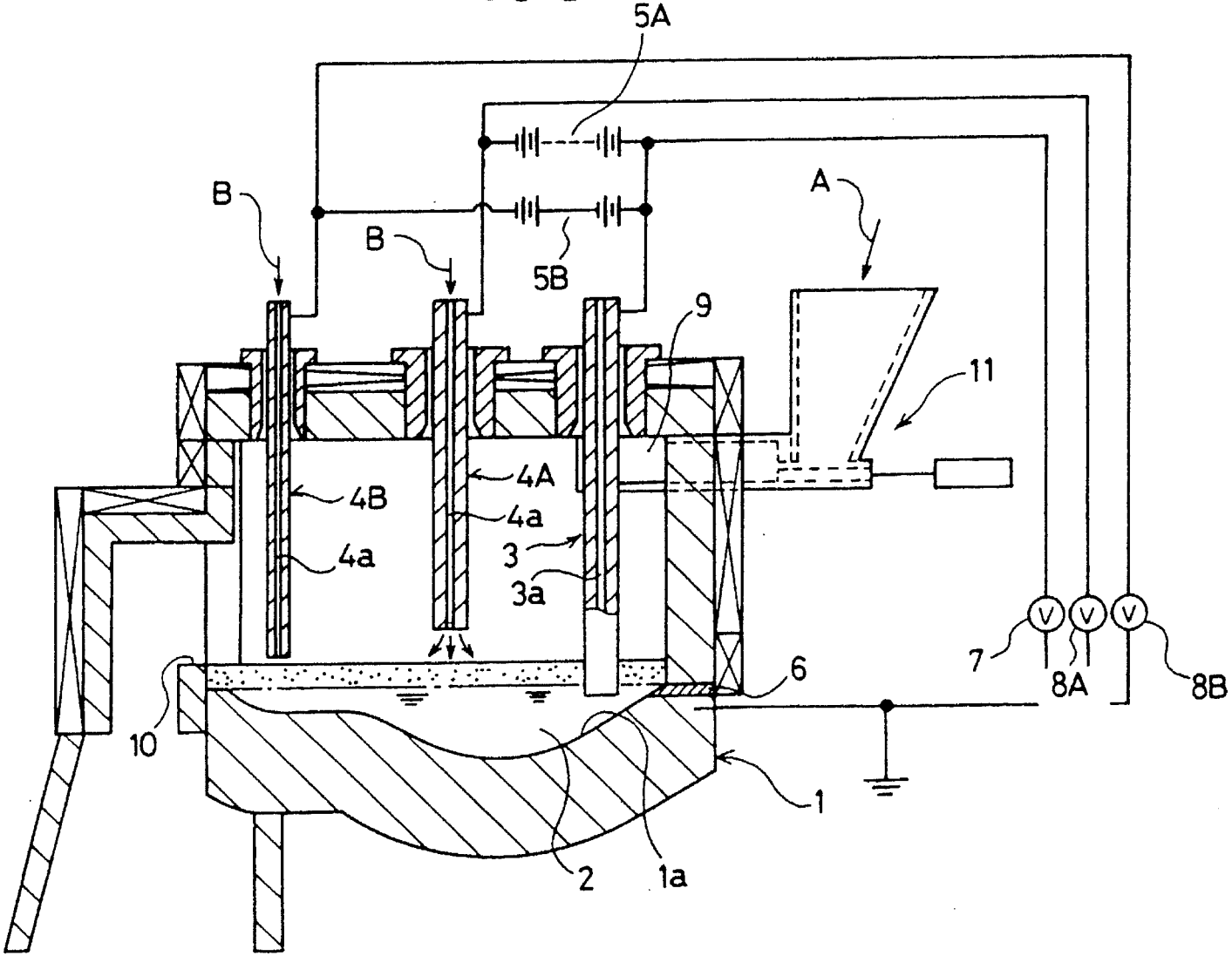
FIG. 2 is a sectional view of a plasma melting furnace in a second embodiment of the invention.

A second embodiment of the invention will now be described with reference to FIG. 2.

The first embodiment described above refers to an arrangement provided with a single anode torch and a single cathode torch. In the second embodiment, however, a plurality of cathode torches, e.g., two cathode torches, are provided for a single anode torch.

That is, a cathode torch 4A is disposed in the middle of the melting chamber 1*a*, and another cathode torch 4B, which is auxiliary, is disposed close to the discharging port 10, while an anode torch 3 is disposed close to the charging port 9. And power sources 5A and 5B are disposed between the anode torch 3 and the cathode torches 4A, 4B, respectively, for feeding predetermined currents. In addition, potentiometers 7, 8A and 8B are installed between the anode torch 3, the cathode torches 4A, 4B and the base metal 2.

Of course, in this case also, the anode torch 3 is positioned at a height such that its lower end is in contact with the base metal 2 on the bottom of the melting chamber 1*a*, while each cathode torch 4 is positioned at a height such that the necessary plasma arc is obtained.

In addition, the furnace operating method is substantially the same as in the first embodiment, and therefore a description thereof is omitted. However, since the auxiliary cathode torch 4B is added, positioned close to the discharging port 10, the operation somewhat differs at the initial stage.

That is, beforehand, a plasma arc is generated between the anode torch 3 and the middle cathode torch 4A and the base metal 2 therebelow is sufficiently melted. At this time, the cathode torch 4B at the discharging port 10 is in contact with the base metal 2 and thereafter this cathode torch 4B is raised, thereby generating a plasma arc.

In addition, in the case where there are a plurality of cathode torches 4, each potentiometer 8 disposed between the base metal 2 and each cathode torch 4 detects the associated potential, and the plasma arc from each cathode torch 4 is controlled on the basis of the detected potential.

In this connection, the second embodiment described above refers to an arrangement provided with two cathode torches 4, but in the case where three or more cathode torches 4 are provided, they are substantially equispaced, as shown in FIGS. 3 through 6, to ensure that smooth melting takes place in the furnace.

Figure 3:
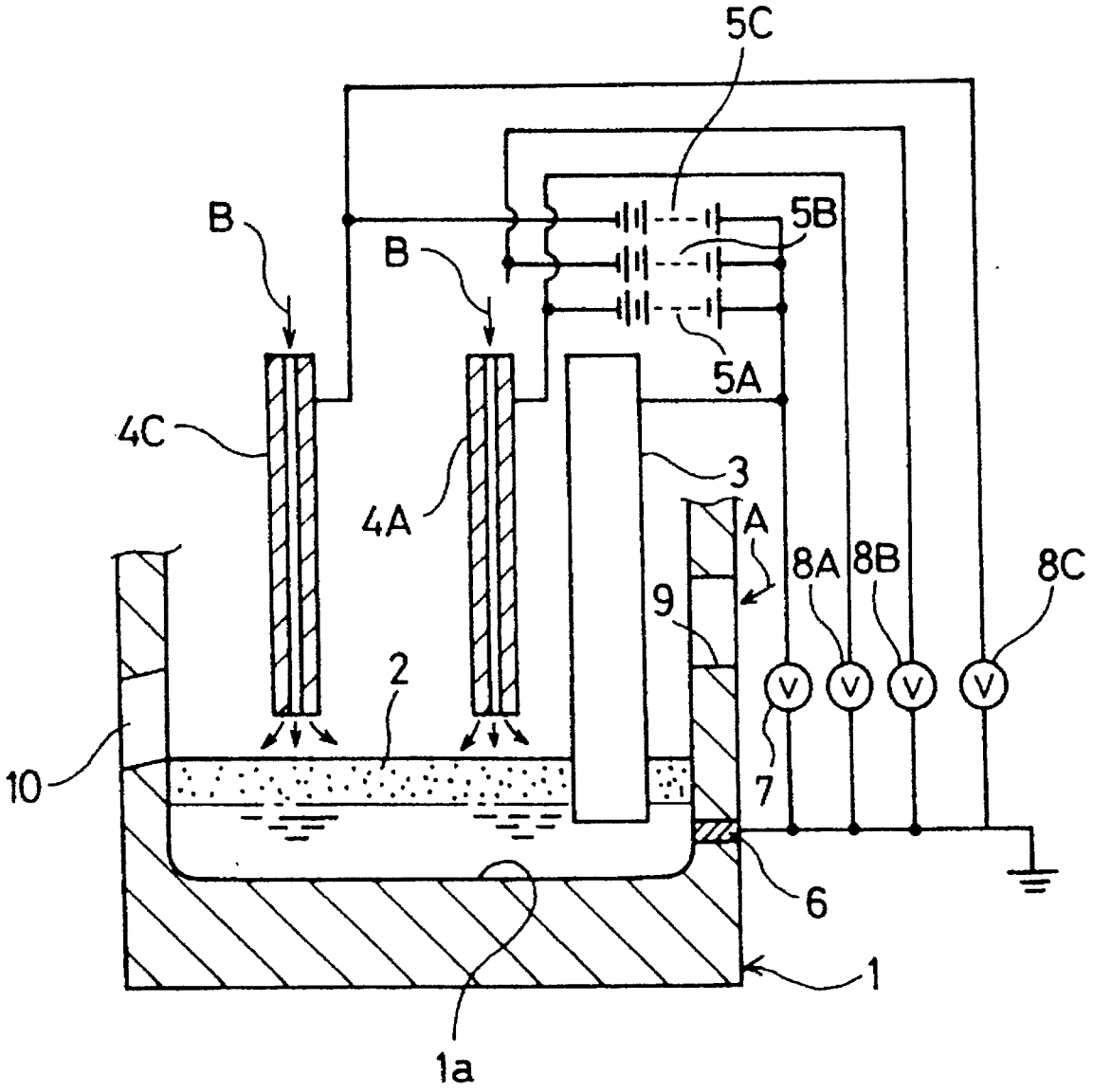
FIG. 3 is a sectional view of a plasma melting furnace according to a modification of the second embodiment.
Figure 4:
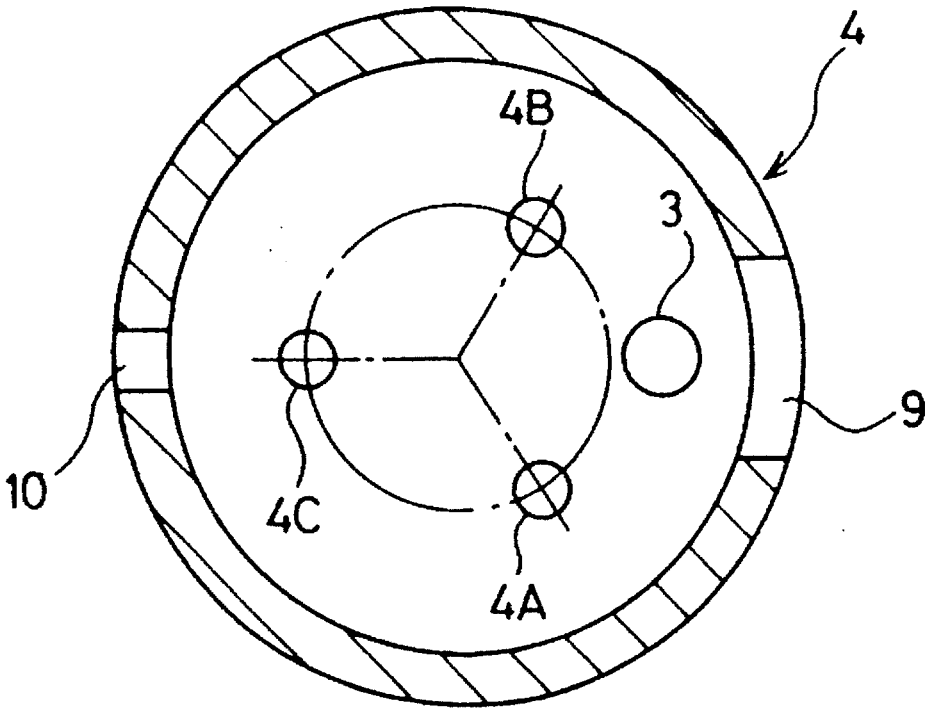
FIG. 4 is a plan view showing an outline arrangement of FIG. 3.
Figure 5:
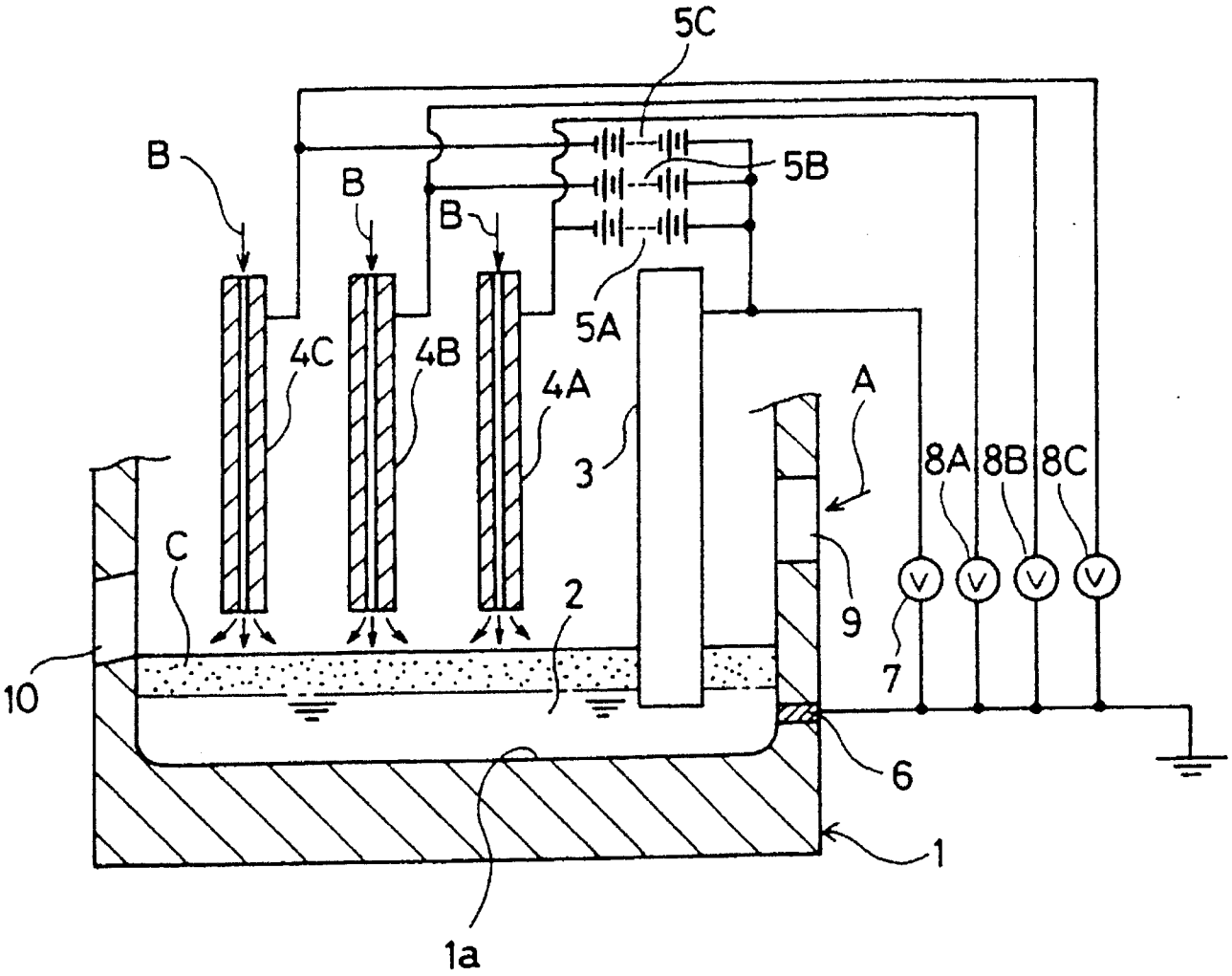
FIG. 5 is a sectional view of a plasma melting furnace according to a modification of the second embodiment.
Figure 6:
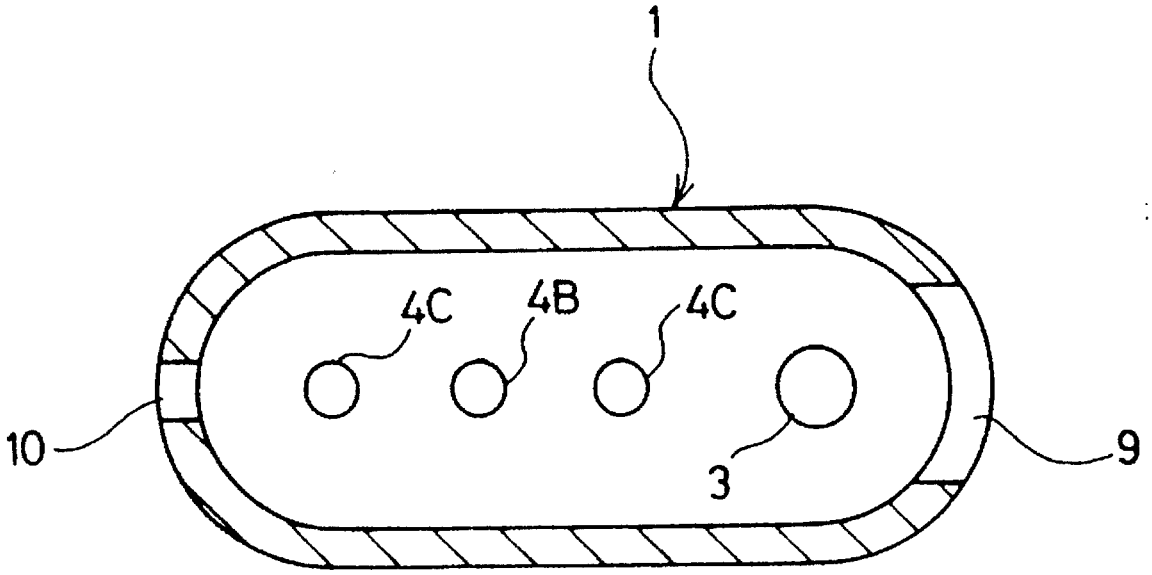
FIG. 6 is a plan view showing an outline arrangement of FIG. 5.

In addition, FIGS. 3 and 4 show a case where cathode torches 4A–4C are disposed at equal intervals on the same circumference, and FIGS. 5 and 6 show a case where cathode torches 4A–4C are disposed at equal intervals on a straight line. Further, the reference characters 5A–5C in the figures indicate power sources to be applied between the anode torch 3 and the cathode torches 4A–4C, and 8A–8C denote potentiometers for detecting potential differences between the cathode torches 4A–4C and the base metal 2. The provision of a plurality of cathode torches, e.g., three cathode torches, besides having the merits of the first embodiment, makes it possible to minimize variations in the temperature of the melt pool and hence facilitate the control of the set conditions for the furnace and suppress local damage to the fire resistance material in the furnace.

Further, since a plurality of cathode torches 4 are installed, melting is effected by a greater amount of more stable plasma arc and hence the heat exchange rate of electric power put into the melting furnace is improved, so that the running cost can be reduced.

That is, the cathode torch disposed at the discharging port for molten slag prevents the fluidity of the molten slag from lowering owing to the cooling thereof, while the plurality of cathode torches disposed substantially in the middle generate stable plasma arcs to effect melting.

Figure 7:
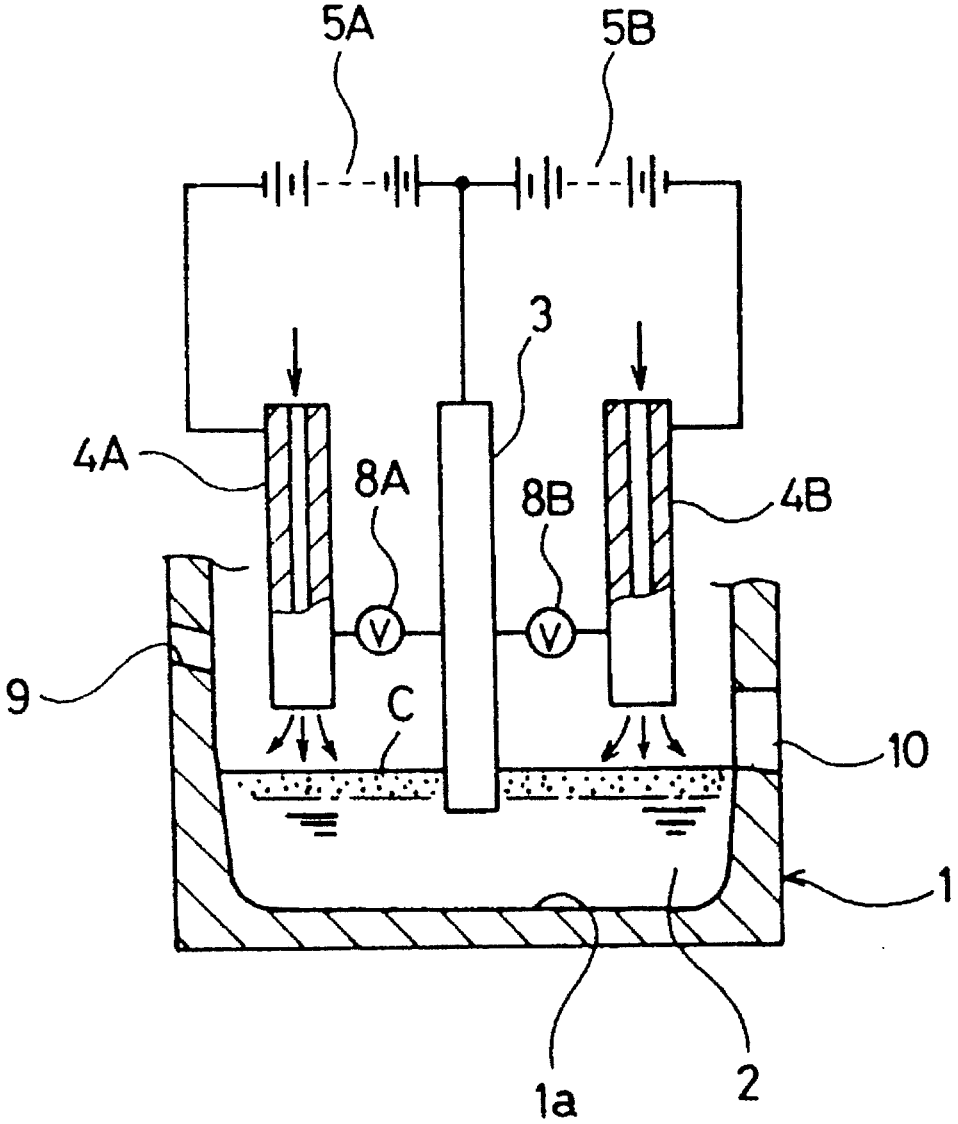
FIG. 7 is a sectional view of a plasma melting furnace according to a modification of the second embodiment.

Further, in the second embodiment described above, the potential difference between the base metal 2 contacted by the anode torch and each cathode torch 4A has been detected to control the plasma arc length thereof; however, as shown in FIG. 7, for example, power sources 5A and 5B may be connected between the anode torch 3 and the individual cathode torches 4A and the potential differences between the anode torch 3 and the individual cathode torches 4A and 4B may be detected by the respective potentiometers 6A and 6B to control the plasma arc lengths.

What is claimed is:

1. A plasma melting method for a plasma melting furnace comprising a melting chamber having a lower region and an upper region, an anode torch having an upper and a lower end, a cathode torch, and an electric conductor located in the lower region of the melting chamber, said method adapted for use during conditions including starting the furnace, increasing the temperature of the furnace, and charging a material to be melted in the furnace, said method comprising the steps of:

moving the anode and cathode torches into contact with the electric conductor to initiate a furnace start; and moving the cathode torch out of contact with the electric conductor to at least one position in the upper region of the melting chamber, generating a plasma arc between the cathode torch and the electric conductor.

2. A plasma melting method as set forth in claim 1, wherein said at least one position of the cathode torch in the upper region of the melting chamber includes a preparatory arc position and a heating arc position, said cathode torch moving to said preparatory arc position to begin generation of the plasma arc between the cathode torch and the electric conductor, and said cathode torch moving to said heating arc position after confirmation of the melting of the electric conductor, to heat the interior of the furnace, said heating arc position being a greater distance from the electric conductor than the preparatory arc position.

3. A plasma melting method for a plasma melting furnace comprising a melting chamber having a lower region and an upper region, an anode torch having an upper and a lower end, a cathode torch, and an electric conductor located in the lower region of the melting chamber, said method comprising the steps of:

moving the anode and cathode torches into contact with the electric conductor to initiate a furnace start;

moving the cathode torch out of contact with the electric conductor, to a preparatory arc position for beginning generation of a plasma arc between the cathode torch and the electric conductor; and after confirmation of the melting of the electric conductor, moving the cathode torch to a heating arc position to heat the interior of the furnace, said heating are position being a greater distance from the electric conductor than said preparatory arc position.

4. A plasma melting method as set forth in claim 3, further comprising the steps of:

heating the atmosphere temperature in the furnace to between approximately 900° and 1,000° C., after confirmation of the melting of the electric conductor in a region near the anode torch, the anode torch is moved to a preparatory arc position to generate a plasma arc between the anode torch and the electric conductor, and after confirmation of the spreading of the melting of the electric conductor in the region near the anode torch, the anode torch is moved to a heating arc position for heating the gas atmosphere in the furnace, said heating arc position being a greater distance from the electric conductor than the preparatory arc position.

5. A plasma melting method as set forth in claim 4, wherein if the plasma arc respectively generated by either the anode torch or the cathode torch is interrupted when the anode and cathode torches are respectively moved during the charging of ash into the furnace, the charging of ash is interrupted and the anode and cathode torches are moved into contact with the electric conductor or the molten slag, whereupon the cathode torch is moved out of contact with the electric conductor to generate a plasma arc between the cathode torch and the electric conductor, to maintain the temperature in the furnace at between approximately 900° and 1,000° C., and thereafter the anode torch is moved out of contact with the electric conductor to generate a plasma arc between the anode torch and the electric conductor, and charging of ash into the furnace is restarted.

6. A plasma melting method for a plasma melting furnace comprising a melting chamber having a lower region and an upper region, an anode torch having an upper and a lower end, a cathode torch, and an electric conductor located in the lower region of the melting chamber, said method comprising the steps of:

moving the anode and cathode torches into contact with the electric conductor to initiate a furnace start;

moving the cathode torch out of contact with the electric conductor to a first position from the electric conductor, to generate a plasma arc and increase the atmosphere temperature in the furnace to between approximately 900° C. and 1,000° C.;

after confirmation of the melting of the electric conductor in a region near the anode torch, moving the anode torch out of contact with the electric conductor to a preparatory arc position, to generate a plasma arc; and after confirmation of the spreading of the melting of the electric conductor in the region near the anode torch, moving the anode torch to a heating arc position, to heat the gas atmosphere in the furnace, said heating arc position being a greater distance from the electric conductor than the preparatory arc position.

7. A plasma melting furnace comprising:

a melting chamber having a lower region and an upper region, an electric conductor located in the lower region of the melting chamber, a movable anode torch made of graphite and having upper and lower ends, said anode torch movable to position wherein the lower end of the anode torch is in contact with the electric conductor; and at least one movable cathode torch made of graphite, said at least one cathode torch movable to a position in the upper region of the melting chamber to generate a plasma arc between the cathode torch and the electric conductor.

8. A plasma melting method for a plasma melting furnace comprising a melting chamber having a lower region and an upper region, an anode torch made of graphite and having upper and lower ends, and at least one cathode torch made of graphite, and an electric conductor located in the lower region of the melting chamber, said plasma melting method adapted for use during conditions including starting the furnace, increasing the temperature of the furnace, and charging a material to be melted in the furnace, said method comprising the steps of:

moving the anode torch and the at least one cathode torch into contact with the electric conductor;

moving the at least one cathode torch to the upper region of the melting chamber to generate a plasma arc between the cathode torch and the electric conductor.

9. A plasma melting method as set forth in claim 8, characterized in that the length of a plasma arc generated between the electric conductor and the at least one cathode torch is controlled on the basis of a potential difference applied between the at least one cathode torch and the electric conductor rendered conductive through the anode torch.

10. A plasma melting furnace as set forth in claim 7, characterized in that the at least one cathode torch is disposed substantially in the middle of the melting chamber.

11. A plasma melting furnace as set forth in claim 7, wherein the anode torch is disposed closer than the at least one cathode torch, to a charging port for a material to be molten.

12. A plasma melting furnace as set forth in claim 10, wherein the anode torch is disposed closer than the at least one cathode torch, to a charging port for a material to be molten.

13. A plasma melting furnace as set forth in claim 7, wherein said furnace has one anode torch and a plurality of cathode torches.

14. A plasma melting furnace as set forth in claim 10, wherein said furnace has one anode torch and a plurality of cathode torches.

15. A plasma melting furnace as set forth in claim 11, wherein said furnace has one anode torch and a plurality of cathode torches.

16. A plasma melting furnace as set forth in claim 12, wherein said furnace has one anode torch and a plurality of cathode torches.

17. A plasma melting furnace as set forth in claim 7, wherein said furnace further comprises at least one potentiometer for providing a potential difference between the at least one cathode torch and the electric conductor rendered conductive through the anode torch, the length of a plasma arc generated between the electric conductor and the at least one cathode torch controlled on the basis of the potential difference.

18. A plasma melting furnace as set forth in claim 10, wherein said furnace further comprises at least one potentiometer for providing a potential difference between the at least one cathode torch and the electric conductor rendered conductive through the anode torch, the length of a plasma arc generated between the electric conductor and the at least one cathode torch controlled on the basis of the potential difference.

19. A plasma melting furnace as set forth in claim 11, wherein said furnace further comprises at least one potentiometer for providing a potential difference between the at least one cathode torch and the electric conductor rendered conductive through the anode torch, the length of a plasma arc generated between the electric conductor and the at least one cathode torch controlled on the basis of the potential difference.

20. A plasma melting furnace as set forth in claim 12, wherein said furnace further comprises at least one potentiometer for providing a potential difference between the at least one cathode torch and the electric conductor rendered conductive through the anode torch, the length of a plasma arc generated between the electric conductor and the at least one cathode torch controlled on the basis of the potential difference.

21. A plasma melting furnace as set forth in claim 13, wherein said furnace further comprises at least one potentiometer for providing a potential difference between the at least one cathode torch and the electric conductor rendered conductive through the anode torch, the length of a plasma arc generated between the electric conductor and the at least one cathode torch controlled on the basis of the potential difference.

22. A plasma melting furnace as set forth in claim 14, wherein said furnace further comprises at least one potentiometer for providing a potential difference between the at least one cathode torch and the electric conductor rendered conductive through the anode torch, the length of a plasma arc generated between the electric conductor and the at least one cathode torch controlled on the basis of the potential difference.

23. A plasma melting furnace as set forth in claim 15, wherein said furnace further comprises at least one potentiometer for providing a potential difference between the at least one cathode torch and the electric conductor rendered conductive through the anode torch, the length of a plasma arc generated between the electric conductor and the at least one cathode torch controlled on the basis of the potential difference.

24. A plasma melting furnace as set forth in claim 16, wherein said furnace further comprises at least one potentiometer for providing a potential difference between the at least one cathode torch and the electric conductor rendered conductive through the anode torch, the length of a plasma arc generated between the electric conductor and the at least one cathode torch controlled on the basis of the potential difference.

25. A plasma melting furnace as set forth in claim 10, wherein said furnace further comprises at least one potentiometer for providing a potential difference between the anode torch and said at least one cathode torch.

26. A plasma melting furnace as set forth in claim 11, wherein said furnace further comprises at least one potentiometer for providing a potential difference between the anode torch and said at least one cathode torch.

27. A plasma melting furnace as set forth in claim 12, wherein said furnace further comprises at least one potentiometer for providing a potential difference between the anode torch and said at least one cathode torch.

28. A plasma melting furnace as set forth in claim 13, wherein said furnace further comprises at least one potentiometer for providing a potential difference between the anode torch and said at least one cathode torch.

29. A plasma melting furnace as set forth in claim 14, wherein said furnace further comprises at least one potentiometer for providing a potential difference between the anode torch and said at least one cathode torch.

30. A plasma melting furnace as set forth in claim 15, wherein said furnace further comprises at least one potentiometer for providing a potential difference between the anode torch and said at least one cathode torch.

31. A plasma melting furnace as set forth in claim 16, wherein said furnace further comprises at least one potentiometer for providing a potential difference between the anode torch and said at least one cathode torch.

32. A plasma melting furnace as set forth in claim 17, wherein said furnace further comprises at least one potentiometer for providing a potential difference between the anode torch and said at least one cathode torch.

33. A plasma melting furnace as set forth in claim 18, wherein said furnace further comprises at least one potentiometer for providing a potential difference between the anode torch and said at least one cathode torch.

34. A plasma melting furnace as set forth in claim 19, wherein said furnace further comprises at least one potentiometer for providing a potential difference between the anode torch and said at least one cathode torch.

35. A plasma melting furnace as set forth in claim 20, wherein said furnace further comprises at least one potentiometer for providing a potential difference between the anode torch and said at least one cathode torch.

36. A plasma melting furnace as set forth in claim 21, wherein said furnace further comprises at least one potentiometer for providing a potential difference between the anode torch and said at least one cathode torch.

37. A plasma melting furnace as set forth in claim 22, wherein said furnace further comprises at least one potentiometer for providing a potential difference between the anode torch and said at least one cathode torch.

38. A plasma melting furnace as set forth in claim 23, wherein said furnace further comprises at least one potentiometer for providing a potential difference between the anode torch and said at least one cathode torch.

39. A plasma melting furnace as set forth in claim 24, wherein said furnace further comprises at least one potentiometer for providing a potential difference between the anode torch and said at least one cathode torch.

* * * * *